United States Patent [19]

Morita

[11] Patent Number: 4,967,580

[45] Date of Patent: Nov. 6, 1990

[54] METHOD AND APPARATUS FOR MAKING DOUBLE-CONED COIL SPRINGS

[75] Inventor: Motoo Morita, Komaki, Japan

[73] Assignee: Morita Iron Works Co., Ltd., Aichi, Japan

[21] Appl. No.: 280,452

[22] Filed: Dec. 6, 1988

[30] Foreign Application Priority Data

Dec. 26, 1987 [JP] Japan ..... 62-331129

[51] Int. Cl.[5] ..... B21F 3/10; B21F 35/02

[52] U.S. Cl. ..... 72/137; 72/139

[58] Field of Search ..... 29/173; 72/128, 137, 72/138, 139, 140, 142; 140/89, 103

[56] References Cited

U.S. PATENT DOCUMENTS

| | | | |
|---|---|---|---|
| 2,456,755 | 12/1948 | Terrell | 72/139 |
| 4,424,695 | 1/1984 | Kirchhoff et al. | 72/137 X |
| 4,571,973 | 2/1986 | Morita | 72/137 |
| 4,719,683 | 1/1988 | Ulbing | 29/173 |

*Primary Examiner*—E. Michael Combs

*Attorney, Agent, or Firm*—Schwartz & Weinrieb

[57] ABSTRACT

Disclosed is a method and device for making a double-coned coil spring, which comprises using a semi-finished spring having formed upon one end thereof a first conically wound portion with the rest of the wound portion extending axially with a constant maximum diameter, and forming a second conically wound portion upon the free end of the cylindrically wound portion; wherein the cylindrically wound portion is clamped at the site from which formation of the second conically wound portion is to be started by means of a first clamping means, and the open end of the cylindrically wound portion is also clamped by means of a second clamping means; and the second clamping means is allowed to rotate in the direction of winding the semi-finished spring, while the second clamping means is forced to be moved radially inwardly toward the center of the semi-finished spring.

4 Claims, 13 Drawing Sheets

METHOD AND APPARATUS FOR MAKING DOUBLE-CONED COIL SPRINGS

(Field of the Invention)

This invention relates to a method of making a double-coned coil spring to be made by using a spring having upon one end thereof a conically wound portion and forming a similar conically wound portion upon the other end thereof, that is, a so-called "barrel-shaped spring" composed of two cones combined at their base portions, and to an apparatus by means of which the aforenoted method can efficiently be achieved.

(Background of the Invention)

As shown in FIG. 12, a double-coned coil spring 1 having a maximum diameter d at the middle of the spring body with both end portions being wound into the shape of a cone gradually tapering toward both end portions in the axial direction is suitably used, for example, as a chassis spring within an automobile and the like as a component of the for independent suspension thereof. Strictly speaking, both wound end portions of this spring have the shape of a truncated cone (that is, a cone whose tip is cut off perpendicularly relative to the axis thereof) or tapering shape gradually decreasing toward both end portions, and as a whole the spring has the shape of a "barrel" or "spindle".

As a method of making such double-coned coil springs, various methods have conventionally been proposed. However, all of them suffer disadvantages in that they involve a number of forming steps, leading to complicated construction of the apparatus itself and wherein further, the winding cannot be achieved with the desired lead angle and pitch thereby causing inconsistencies in the shape of the finished products. Namely, since the aforenoted double-coned spring is wound so as to taper toward both end portions, it is difficult to effect the entire winding process in a single step such as when an ordinary cylindrical coil spring is formed using a removable mandrel.

In this connection, in the invention disclosed in Japanese Provisional Patent Publication No. 11743/1982 and in the corresponding U.S. Pat. No. 4,424,695, it has been proposed to provide a forming member 18 having formed thereon a spirally stepped conical portion having the required number of turns, to insert this forming member 18 through a gap of the cylindrically wound portion so as to force the cylindrical coil to be wound around the above spirally stepped conical portion and thereby form the cylindrical portion of the spring into a conically wound portion. However, according to the apparatus proposed above, the size of the forming member 18 having formed thereon a spirally stepped conical portion is limited to one which allows insertion of the forming member 18 through the gap in the cylindrically wound portion of the spring, thereby only permitting a conically wound portion with at most two or two and one half winds to be formed.

(Object of the Invention)

Under such circumstances, this invention has been proposed to provide a method of making a double-coned spring, according to which a spring having formed upon one end thereof a first conically wound portion with the rest of the wound portion of the spring being axially extended and characterized by means of a constant maximum diameter is first made in accordance with a first process step; and a second conical portion can be formed at the other end of this unfinished spring (hereinafter referred to as "semi-finished spring") by means of a second process winding step; wherein forming jigs to be employed therefor need not be limited to only those which can be inserted through the gap of the cylindrically wound portion; and the number of turns defined within the second conical portion can easily comprise three or more turns. An as desired, and an apparatus for practicing the aforenoted method is also disclosed.

(Summary of the Invention)

To describe in detail, the method of making a double-coned coil spring (hereinafter simply referred to as a "double-coned spring") according to this invention comprises using a semi-finished spring having formed upon one end thereof a first conically wound portion with the reset of the wound portion being axially extended with a constant maximum diameter; and forming a second conically wound portion upon the free end of the cylindrically wound portion;

wherein the above cylindrically wound portion is clamped at the site from where formation of the second conically wound portion is to be started by means of a first means, and also clamping the open end of the above cylindrically wound portion is clamped by means of a second clamping means; and the second clamping means is allowed to rotate in the direction of winding the semi-finished spring, while being simultaneously forced radially inwardly toward the center of the semi-finished spring.

In addition, the apparatus for efficiently practicing the above method of making a double-coned spring according to this invention using a semi-finished spring having formed upon one end thereof a first conically wound portion with the rest of the wound portion extending axially with a constant maximum diameter, and is particular for forming a second conically wound portion upon the free end of the cylindrically wound portion, comprises:

a bed upon which a semi-finished spring can be loaded horizontally;

a first clamping means disposed upon the above bed, which releasably clamps the above semi-finished spring at the site from which formation of the second conically wound portion is to be started;

a conical guide member formed upon the above first clamping means, having a pitch such that it may provide a curve substantially equal to that of a conical coil portion to be finally formed by means of the winding process from the semi-finished spring;

a movable head disposed so as to oppose the above bed beyond the above first clamping means, which can be moved closer or farther relative to the above bed;

a second clamping means disposed upon the above movable head such that it can slide in the direction intersecting the direction of moving the movable head, which releasably clamps the free end of the cylindrically wound portion of the above semi-finished spring;

a means for forcing the second clamping means to rotate in the direction of winding the semi-finished spring; and a means for forcing the above second clamping means to move radially inwardly toward the axis of the semi-finished spring.

As has been described above, according to the method and apparatus of this invention, a second conical portion having a desired pitch can accurately be formed at the free end of the cylindrically wound portion of a semi-finished spring having formed upon one end thereof a first conically wound portion with the rest of the wound portion extending axially with a constant maximum diameter by clamping the above cylindrically wound portion at the site from which formation of the second conically wound portion is to be started by means of the first clamping means, and also by clamping the open end of the above cylindrically wound portion by means of the second clamping means; and by causing a rotary motion to be inparted to the second clamping means; and also forcing the second clamping means to simultaneously move radially inwardly toward the axis of the semi-finished spring so as to force the above cylindrically-wound portion to be wound around the forming jig positioned interiorly of the spring.

This invention provides the advantage of achieving accurate and economic formation of the double-coned coil spring using a simple mechanism. The forming jigs to be employed within the apparatus according to this invention can be inserted from the open end of the cylindrically wound portion of the semi-finished spring, so that they are not necessarily limited to the conventional jigs which must be able to be inserted through the spring gap or pitch of the cylindrically wound portion. Accordingly, the number of loops in the second conical portion can be increased to three loops or more, as desired, and thus this invention can readily cope with the diverse demands of users.

(Brief Descripition of the Drawings)

Various other objects, features, and attendant advantages of the present invention will be better understood from the following detailed description when considered in connection with the accompanying drawings, in which like reference characters designated like or corresponding parts throughout the several views, and wherein:

FIG. 5 is a front view of the second clamping means wherein

FIG. 5(*a*) shows the state before the end of the semi-finished spring is clamped by means of the second clamping means, and FIG. 5(*b*) shows the state where the end of the semi-finished spring is clamped by means of the second clamping means;

Figure 6A:
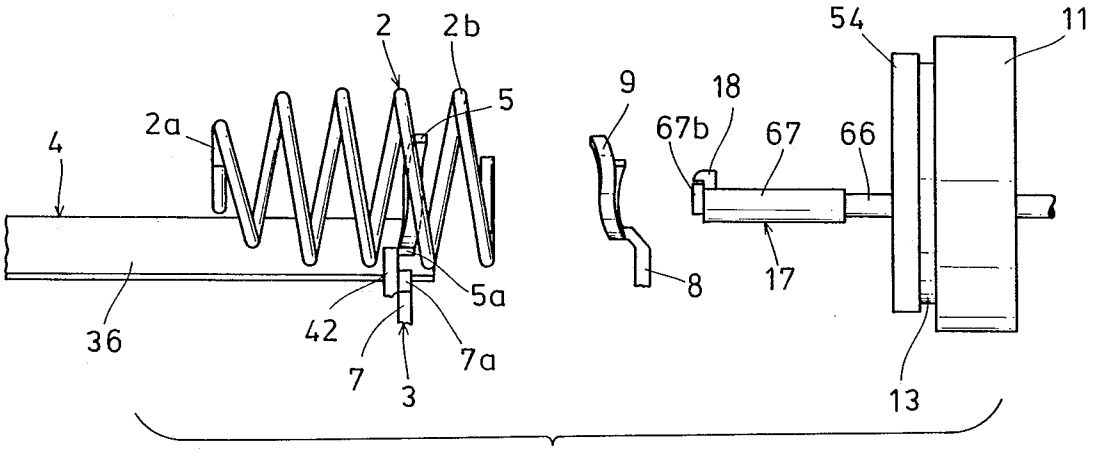
Figure 6B:
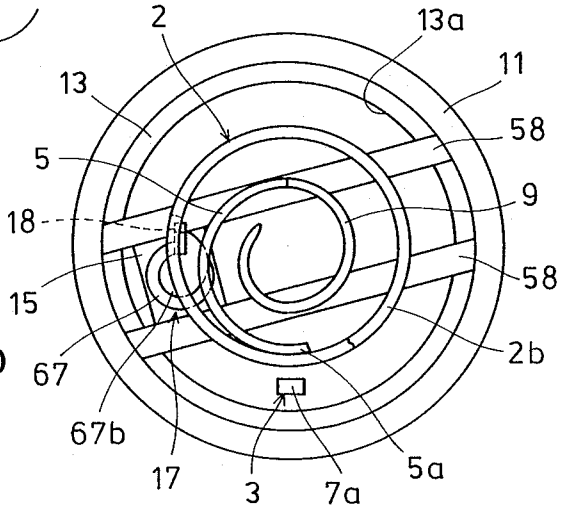
Figure 12:
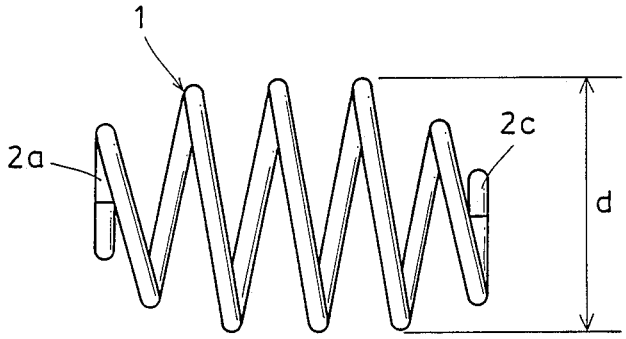
Figure 13:
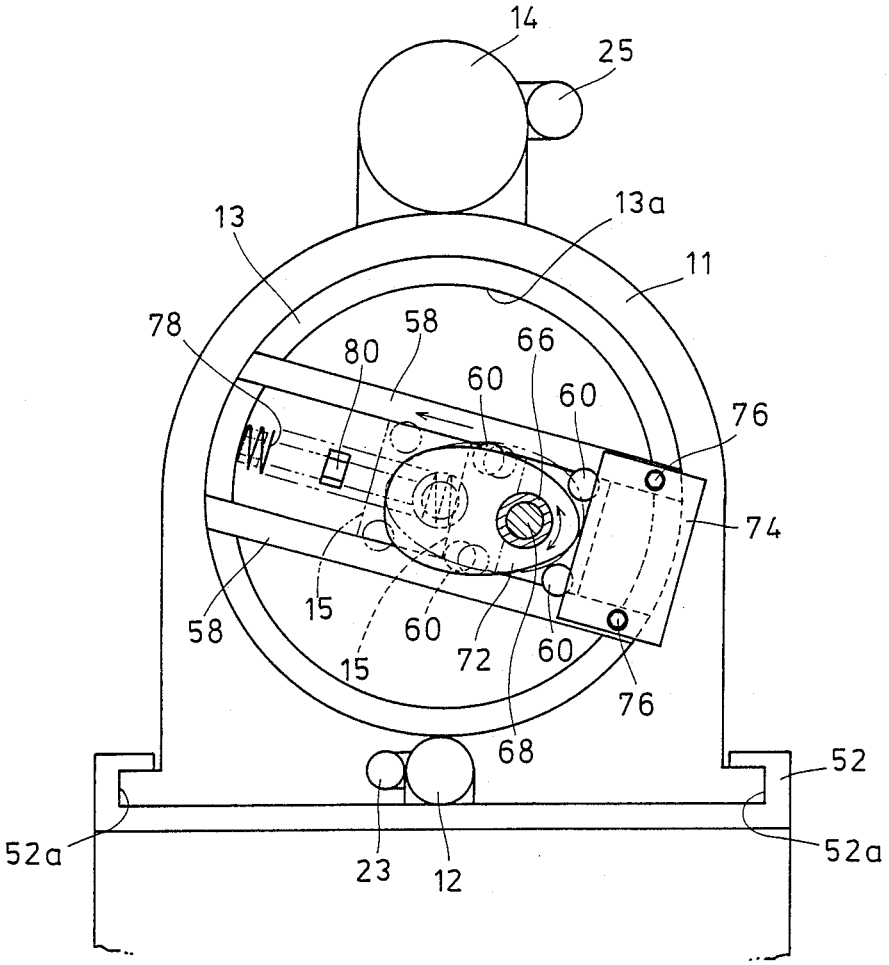
Figure 14:
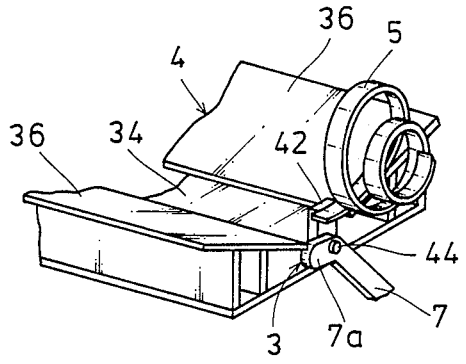
Figure 15:
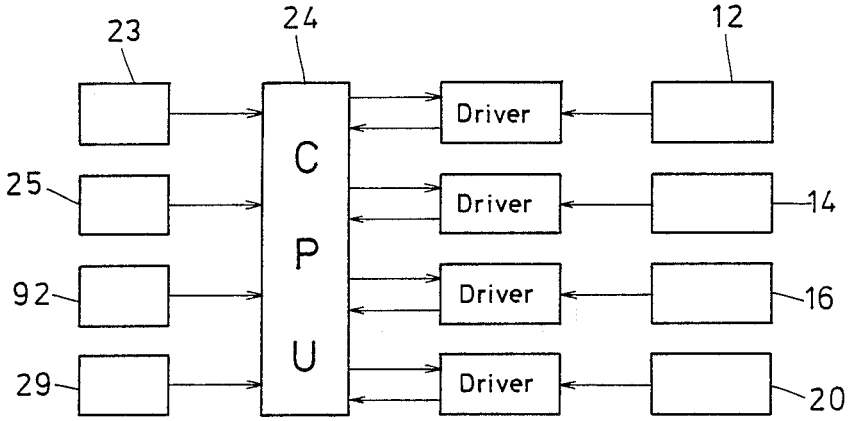

FIGS. 6(*a*) to 11(*a*) illustrate movements of the apparatus according to this invention with the passage of time; whereas FIGS. 6(*b*) to 11(*b*) each illustrate a view of the semi-finished spring as seen in the axial direction in the state corresponding to that shown in FIGS. 6(*a*) to 11(*a*), respectively;

FIG. 12 is a front view showing the appearance and constitution of the double-coned spring;

FIG. 13 is a right side view of another embodiment of the mechanism for moving the slider to be used in the apparatus of the present embodiment in the diametrical direction of the rotor;

FIG. 14 is a perspective view of the major portion of another embodiment of the conical guide member to be employed in the apparatus of the present embodiment; and FIG. 15 is a block diagram of the control circuit of the apparatus of the present embodiment.

(Detailed Description of the Invention)

Figure 1:
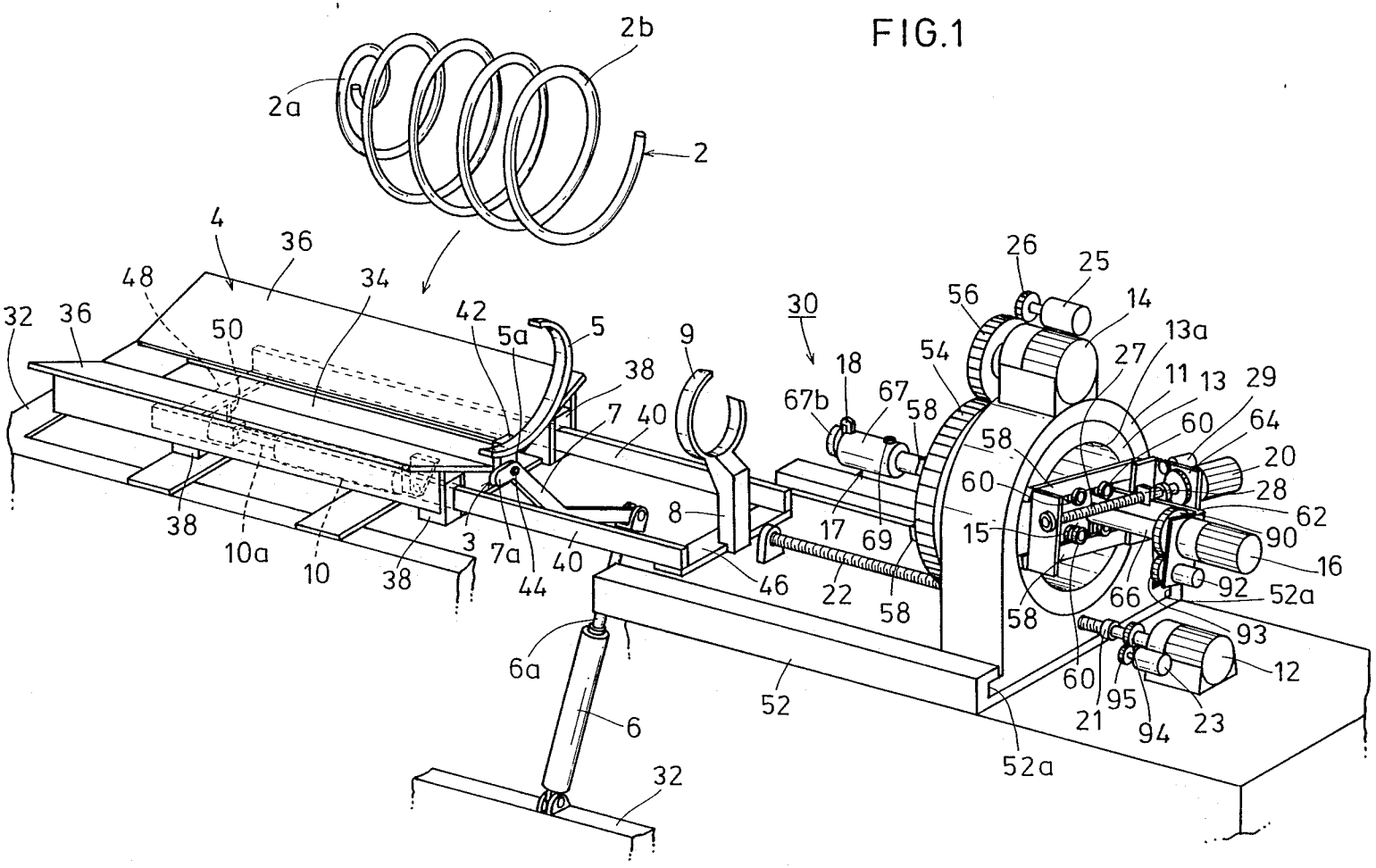
FIG. 1 shows schematically a preferred embodiment of the apparatus constructed according to this invention in perspective view.

Now, the method of making a double-coned spring according to this invention will be described below correlated with an apparatus by means of which the above method can efficiently be practiced. FIG. 1 shows schematically the construction of the double-coned spring making apparatus in a perspective view by means of which the present method can be practiced. In this double-coned spring making apparatus 30, a double-coned spring 1, as shown in FIG. 12, having a first conical portion 2*a* and a second conical portion 2*c* combined at their base portions is finally wound and formed by using a semi-finished spring 2 comprising a first conical portion 2*a* and a cylindrically wound portion 2*b* which extends axially with a constant maximum diameter and winding the cylindrcially wound portion 2*b* so as to gradually reduce the diameter thereof.

As shown in FIG. 1, a bed 4 is disposed at an upper left position with respect to a base 32 of the apparatus 30, and comprises a pair of elongated plate members 36 which are disposed upon a bottom plate 34 fixed upon the above base 32 so as to form an obtuse angle therebetween, and upon which a semi-finished spring 2 can be horizontally loaded. Incidentally, in the state where a semi-finished spring 2 is loaded upon the bed 4, the plate members 36 have preliminarily been set so as to have a slope angle such that the axis of the semi-finished spring 2 is aligned with that of a rotor 13 to be described later. Upon the bottom surfaces of the plate members 36, a plurality of guides 38 are provided so as to protrude therefrom, respectively, and guide bars 40 to which a location regulating means 8 (to be described later) is secured are slidably disposed within to these guides 38.

A first clamping means 3 is disposed upon the right end portion of the bed 4 for releasably clamping the semi-finished spring 2, loaded horizontally upon the bed 4, at the site from which formulation of second conical portion 2*c* is started. Namely, upon bottom plate 34, a supporting member 42 is removably attached to the bottom plate 34 between the two plate members 36 also disposed upon the bottom plate 34 and a clamping member 7*a* formed upon one end of a lever 7 is pivoted to this supporting member 42 through means of a pin 44. To the other end of this lever 7, a piston rod 6*a* of a cylinder 6 disposed upon the base 32 is attached so as to cause an oscillatory movement to the lever 7 to be pivoted about the axis of the pin 44 upon actuation of the cylinder 6. Furthermore, a conical guide member 5 having a pitch such that it may provide a pitch substantially equal to that of a conical coil portion to be finally wound and formed upon the semi-finished spring 2 is attached to the supporting member 42 disposed above the clamping member 7*a*, so that the semi-finished spring 2 may be clamped at the site from which the formation of the second conical portion 2*c* is started between the base portion 5*a* of this conical guide member 5 and the clamping member 7*a*.

Figure 2:
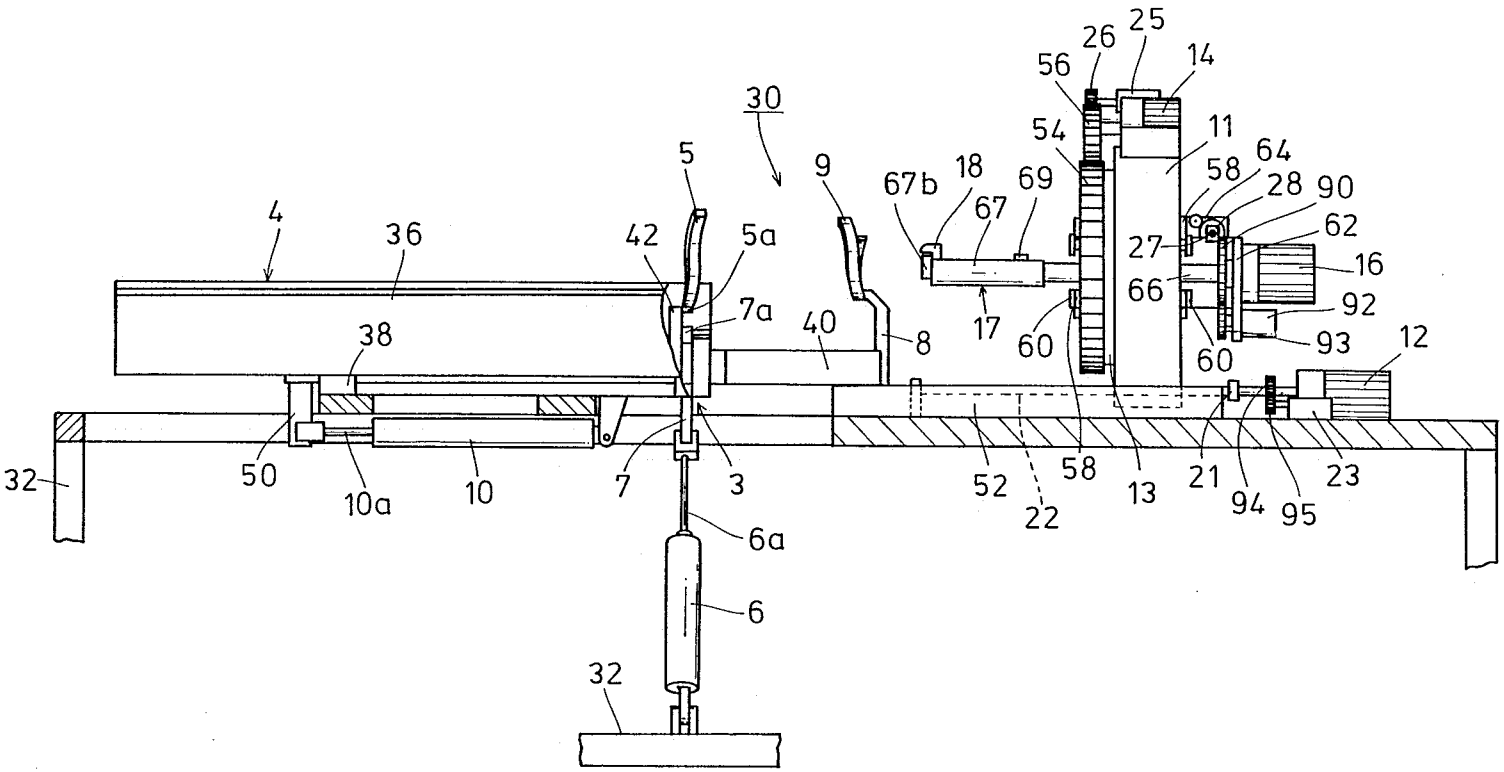
FIG. 2 is a front view of the apparatus shown in FIG. 1 partially in vertical cross-section.
Figure 7A:
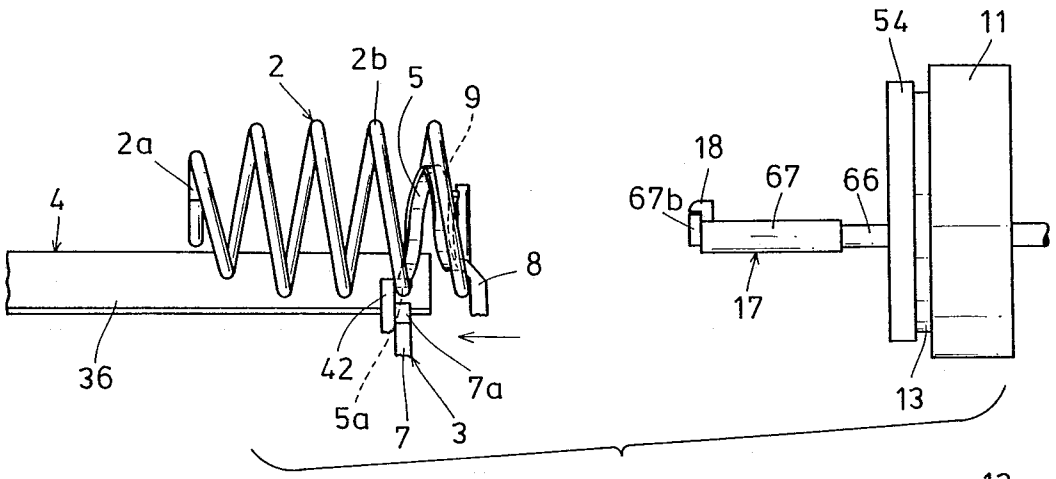
Figure 7B:
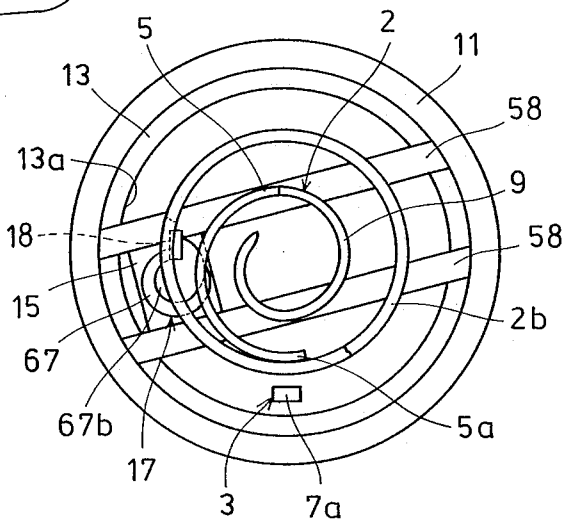

The guide bars 40 slidably inserted within guides 38 extend toward the right side of the above bed 4 (that is, the side where the above first clamping means 3 is disposed), and a mounting member 46 from which the location regulating means 8 protrudes is attached to the ends of these guide bars 40 so as to be removably fixed upon the bottom surfaces thereof by means of bolts (not shown). Also, a connecting member 48 is attached to the other ends of the guide bars 40, and a protrusion 50 is formed upon the bottom surface of this connecting member 48. As shown in FIG. 2, a piston rod 10*a* of a cylinder 10 disposed upon the bottom surface of the bottom plate 34 of the bed 4 is attached to this protrusion 50, so that the location regulating means 8 may be moved closer to farther relative to the bed 4 by means of this cylinder 10. To describe the operation more in detail, as shown in FIG. 7(*a*), the location regulating means 8 functions so that it may perform positioning of the semi-finished spring 2 by engaging, under pressurized force the cylindrically wound portion 2*b* at the proximity of the open end, when the location regulating means 8 is moved closer toward the cylindrically wound portin 2*b* of the above spring 2 loaded upon the bed 4.

At the top of the location regulating means 8, there is provided a conical guide member 9 standing upright which can be inserted into the cylindrically wound portion 2*b* of the semi-finished spring 2 along the axial direction thereof. This conical guide member 9 cooperates with the conical guide member 5 provided upon the above first clamping means 3 (see FIG. 7(*a*)) so as to define the direction of winding of the second conical portion 2*c* to be formed upon the semi-finished spring 2. Incidentally, both the supporting member 42 and the mounting member 46, upon which the two conical guide members 5 and 9 are provided, are constituted so that they may be removable from the bed 4 and the guide bars 40, respectively, whereby the conical guide members 5 and 9 can be readily and speedily replaced by other similar coponents depending upon the specifications, such as, for example, when the diameter of the semi-finished spring 2 to be formed is changed according to a particular customer order.

Moreover, as shown in FIG. 14, when the conical guide member 5 is formed into a cone having two or more turns, the direction of winding the second conical portion 2*c* to be formed upon the semi-finished spring 2 can be defined by means of the conical guide member 5 alone and the above conical guide member 9 can be omitted. In this system, however, the axial length of the conical guide member 5 is designed so as to have a size shorter than the gap of the cylindrically wound portion 2*b* of the spring 2 to be formed.

Upon the base 32, on the side opposite to the location of the bed 4 and beyond the above first clamping means 3, a guide 52 having formed therein parallel guide grooves 52*a* is fixed, and a movable head 11 is disposed upon this guide 52 so as to be movable at a horizontal level substantially the same as that of the bed 4; wherein a servomotor 12 is disposed upon the base 32 on the right side of the guide 52, that is, on the side opposite that of the bed 4, and a screw bolt 22 fixed to the rotary shaft of the servomotor 12 through means of a coupling 21 is threadedly engaged with a nut (not shown) provided upon the movable head 11. Therefore, by driving the servomotor 12, the movable head 11 is moved closer or farther relative to the above bed 4 under cooperation of the screw bolt 22 and the above nut.

Incidentally, a gear 94 is attached to the rotary shaft of the servomotor 12, which gear 94 is engaged with another gear 95 attached to the input shaft of an encoder 23; whereby output signals from the encoder 23 are as shown in FIG. 15 inputted to a central processing unit (CPU) 24 such as, for example, a micro computer and the like, whereby the location of the above movable head 11 can be controlled by achieving drive control of the motor 12 based upon the above signals inputted into the CPU 24.

Within the movable head 11, there is rotatably disposed a cylindrical rotor 13 whose axis is substantially aligned with that of the semi-finished spring 2 loaded horizontally upon the bed 4. As shown in FIG. 2, one end of this rotor 13 directing toward the bed 4 protrudes from the movable head 11 in the axial direction, and a gear 54 is formed upon the circumference of this protrusion. A servomotor 14 is mounted upon the upper part of the movable head 11, and a gear 56 attached to the output shaft of this motor 14 engages with the above gear 54. Thus, the rotor 13 is designed to be rotated for forward or reverse motion means of the servomotor 14 so as to achieve positioning of a winding means 17 to be described later. Furthermore, a gear 26 attached to the input shaft of an encoder 25 is engaged with this gear 56, so that the rotation angle of the rotor 13 can be detected. Incidentally, output signals from this encoder 25 are inputted into the above CPU 24.

Figure 3:
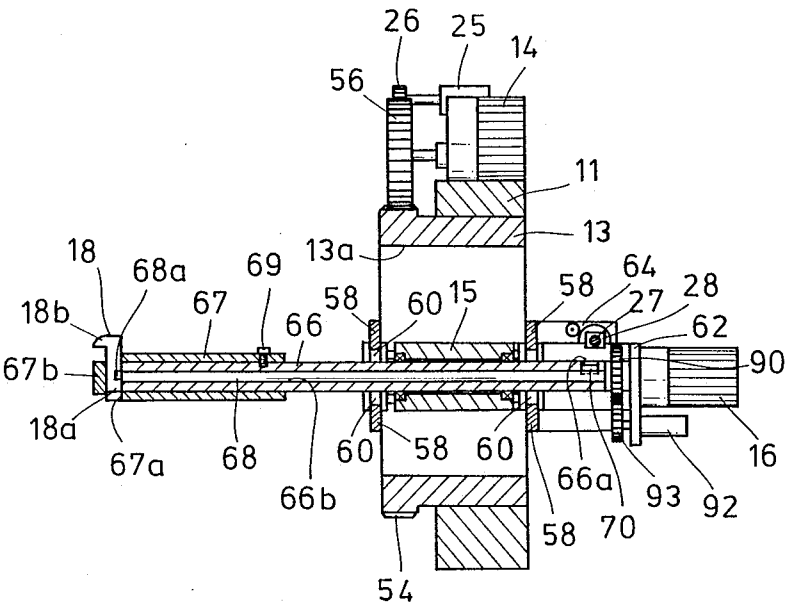
FIG. 3 is a vertical cross-section of the movable head.

Upon each end of the rotor 13 relative to the axial direction, a pair of guide rails 58 are disposed upon both sides of the axis of the above rotor 13 so as to be parallel in the diametrical direction thereof, respectively, so that a slider 15 disposed within the through hole 13*a* of the rotor 13, as best seen in Figure may be movable along the above guide rails 58. To describe such in detail, as shown in FIGS. 1 and 3, four rollers 60 are rotatably fixed upon the right and left sides of the slider 15, respectively, and these four rollers 60 engage the guide rails 58, respectively, such that they can roll therealong. Furthermore, upon one end in the longitudinal direction of each guide rail 58, and L-shaped bracket 64 is disposed, upon which a servomotor 20 is disposed. A screw bolt 27 fixed to the rotary shaft (not shown) of this motor 20 through means of a coupling (not shown) is threadedly engaged with a nut 28 provided upon a bracket 62 attached to the slider 15. Accordingly, the slider 15 is reciprocated diametrically so as to pass through the rotational center of the rotor 13 by driving the servomotor 20. Incidentally, the reference numeral 29 designates an encoder which detects the amount of rotation of the above motor 20 and inputs the detection signal into the CPU 24, whereby the location regulation of the slider 15 can be achieved.

Next, a winding means 17 is disposed upon the left end of the slider 15, so as to be inserted through the slider 15 parallel to the rotational center of the above rotor 13 and extends in the axial direction. This winding means 17 is composed of a hollow rotary shaft 66 rotatably supported upon the slider 15, a winder 67 disposed upon the rotary shaft 66 at the end extending toward the bed 4, and a main shaft 68 which is inserted within the hollow rotary shaft 66 and is integrally rotated with the rotary shaft 66 by driving the servomotor 16. To describe such more in detail, as shown in FIG. 3, the hollow rotary shaft 66 is rotatably supported by the means of the slider 15 through means of a bearing, and the winder 67 is fitted over one end of the rotary shaft 66 through means of a bolt 69. Incidentally, at the tip of the winder 67, there is disposed a guide piece 67*b* which defines the direction of winding of the second conical portion 2c to be formed upon the semi-finished spring 2 and also clamps the end of the semi-finished spring 2 in cooperation with a second clamping means 18 to be described later.

Figure 4:
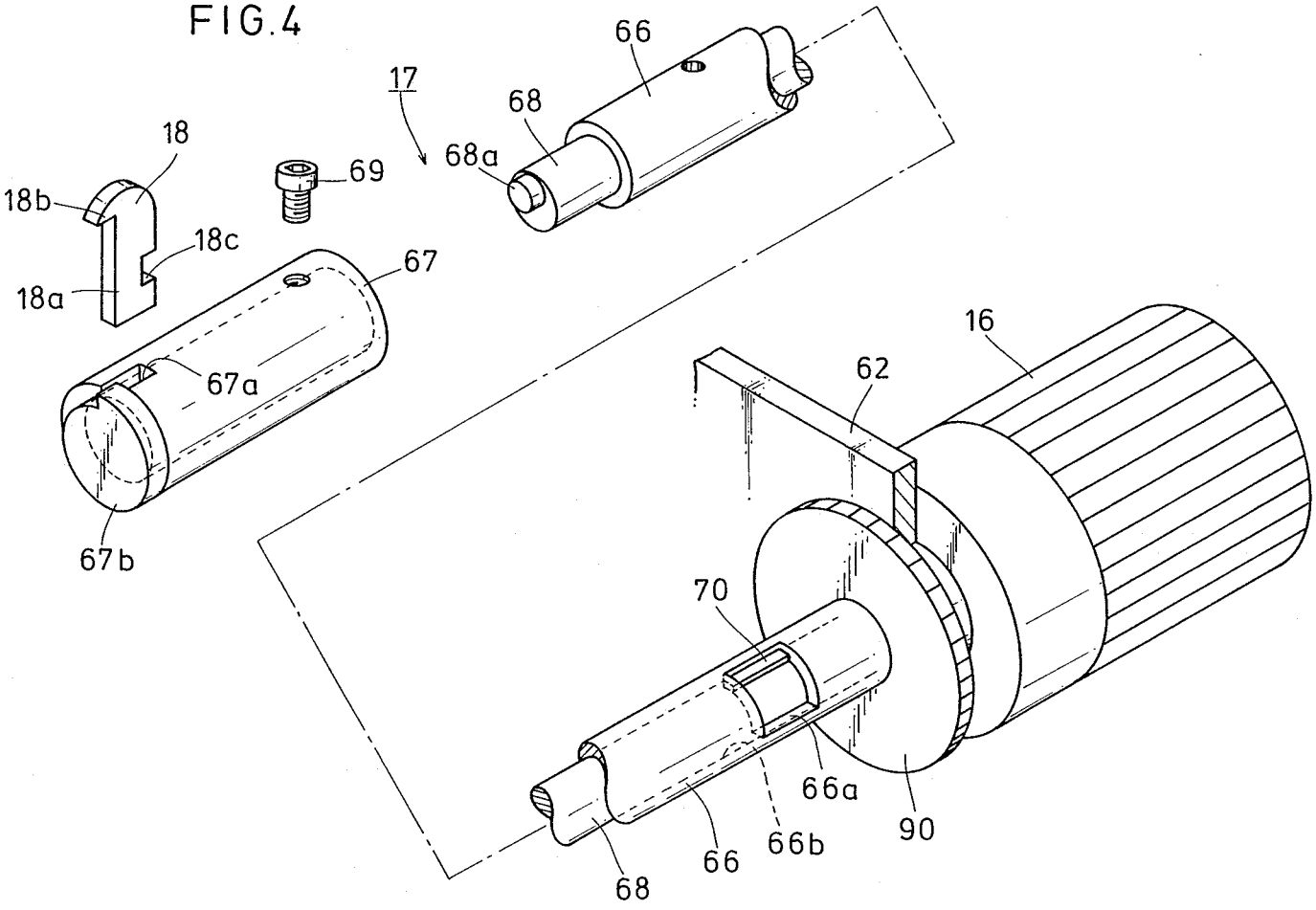
FIG. 4 shows schematically the construction of the winding means and the second clamping means in exploded perspective view.

Within the hollow space 66b of the above rotary shaft 66, the main shaft 68 is inserted, and the right end of this main shaft 68 is connected to the rotary shaft (not shown) of the servomotor 16 disposed upon the above bracket 62 through means of a coupling (not shown). Furthermore, a key 70 is provided upon the main shaft 66 so as to protrude from the outer periphery thereof, as shown in FIG. 4, and this key 70 is disposed within a key groove 66a formed within the rotary shaft 66, such that the main shaft 68 and the rotary shaft 66 may integrally be rotated. Accordingly, by driving the servomotor 16, the main shaft 68 and the rotary shaft 66 are integrally rotated in a predetermined direction that is, (in the direction of winding the second conical portion 2c of the semi-finished spring 2).

Incidentally, an encoder 92 is mounted upon the above bracket 62, and a gear 93 attached to the input shaft of the encoder 92 is engaged with a gear 90 attached to the rotary shaft of the servomotor 16; whereby the rotation angle of the main shaft 68 and the rotary shaft 66 can be detected and inputted into the above CPU 24.

Figure 5A:
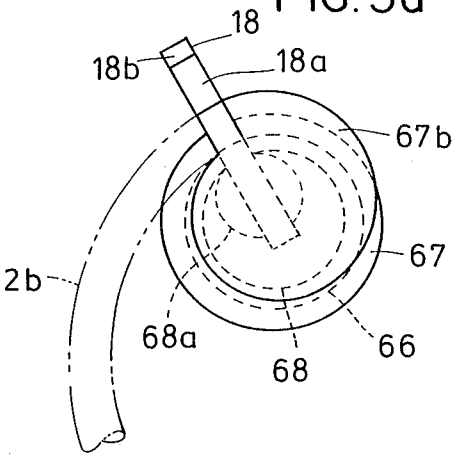
Figure 5B:
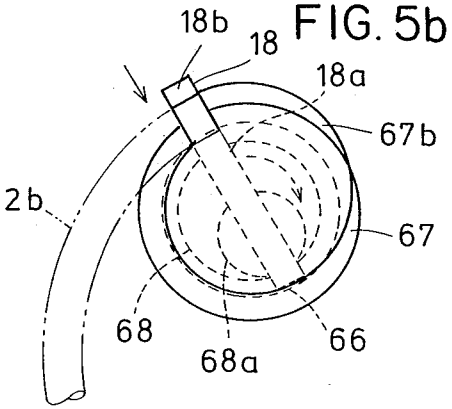

As shown in FIG. 4, a diametrical through hole 67a is formed upon the right side, relative to the axial direction, of the guide piece 67b disposed upon the winder 67, and a second clamping means 18 is inserted through this through hole 67a by means of a mechanism to be described later, such that it can move along the through hole 67a. This second clamping means 18 is composed of an L-shaped clamping member; wherein a recess 18c opening toward the axis of the rotary shaft 66 is formed within the long leg portion 18a of the clamping member 18 to be inserted into this through hole 67a, wherein an eccentric protrusion 68a formed upon the front end of the above main shaft 68 engages this recess 18c (see FIG. 5). Namely, as the main shaft 68 rotates, the clamping member 18 engaged with the eccentric protrusion 68a of the main shaft 68 moves diametrically within the through hole 67a as shown in FIG. 5 (b) so as to clamp the end of the semi-finished spring 2 between the horizontal projection 18b and the circumference of the above guide piece 67b. It should be noted that the clamping member 18 is designed to move within the above through hole 67a only when the main shaft 68 is rotated in the direction of forming the second conical portion 2c of the semi-finished spring 2.

Next, FIG. 13 shows another embodiment for shifting the slider to be used in the present apparatus in the diametrical direction with respect to the rotor, wherein a cam 72 fixed to the rotary shaft 66 is used for shifting the slider 15. As shown in FIG. 13, a rectangular regulating plate 74 is removably attached to one end of the guide rails 58 disposed upon the rotor 13 through means of a plurality of bolts 76. A cam 72 having a shape as shown in FIG. 13 is also fixed to the rotary shaft 66 disposed within the slider 15 at a position where the circumference of the cam 72 can be engaged with the regulating plate 74, and a compression spring 78 is interposed between the slider 15 and the internal peripheral surface of the rotor 13. Namely, the compression spring 78 functions not only to constantly bias the slider 15 in the direction such that the latter tends to be spaced from the center of the rotor 13, but also to cause the circumference of the cam 72 to be disposed in contact with the regulating plate 74.

Accordingly, when the rotary shaft 66 is rotated, the cam 72 rotates with the circumference thereof being in contact with the end of the regulating plate 74, whereby the slider 15 can be shifted toward the center of the rotor 13 as shown by means of the dotted chain line in FIG. 13. Incidentally, a stopper 80 which can be disposed against the internal peripheral surface of the rotor 13 and whose length or disposition relative to rotor 13 is adjustable is disposed opposite slider 15. By adjusting the or disposition of this stopper 80 and also by varying the shape of the cam 72, the center of the second conical portion 2c to be formed upon the semi-finished spring 2 can be off-set from the center of the cylindrically wound portion 2b.

Furthermore, as described above, the outputs from the above encoders 23, 25, 92 and 29 are inputted into the above CPU 24, and such inputted signals are operatively correlated with the numerical information preliminarily inputted into the CPU 24 so as to effect drive control of the above servomotors 12, 14, 16 and 20 through means of suitable drivers, respectively (see FIG. 15). Thus, the length of travel of the movable head 11, and the rotational angles of the rotary shaft 66 and the main shaft 68, as well as the rotational angle of the rotor 13 and the disposition of the slider 15, can be controlled.

Next, the function of the spring making apparatus shown in the embodiment having the aforenoted construction will be described in connection with the method of making the double-coned spring. First, as shown in FIG. 1, a semi-finished spring 2 having formed upon one end thereof a first conical portion 2a with the rest of the wound portion comprising a cylindrically wound portion 2b extending axially with a constant maximum diameter from the first conical portion 2a is loaded upon the bed 4 provided upon the apparatus 30; wherein the semi-finished spring 2 has been heated to approximately 850° to 900° C. in the previous step and is waiting for the subsequent hot processing, as well as the hardening process to which the spring is to be subjected to in a later process step.

The semi-finished spring 2 heated to such high temperature is released at a position directly above the bed 4 and lowered straight downward in a required horizontal posture onto the predetermined position of the above bed 4; whereby the semi-finished spring 2 is loaded onto the bed 4 with its cylindrically wound portion 2b directed toward the above movable head 11. During this process, the conical guide member 5 of the first clamping means 3 is inserted into the cylindrically wound portion 2b of the semi-finished spring 2 through means of the gap thereof as shown in FIG. 6(a). Since the posture of lowering the semi-finished spring 2 is preliminarily controlled, the portion near the site from which formation of the second conical portion 2c of the spring 2 is started is adapted to be positioned in front of the first clamping means 3; and similarly for the open end of the cylindrically wound portion 2b.

In this state, the cylinder 10 is actuated so as to move the location regulating means 8 movably disposed upon the bed 4 toward the cylindrically wound portion 2b of the semi-finished spring 2, whereby the base portion of the location regulating means 8 is disposed in contact with the cylindrically wound portion 2b at the portion near its free end, and the spring 2 is slightly shifted upon the bed 4 toward the first clamping means 3 so as to finally effect axial positioning of the spring 2 between the first clamping means 3 and the location regulating means 8, as shown in FIG. 7(*a*). In this process, the conical guide member 9 provided upon the location regulating means 8 is disposed within the cylindrically wound portion 2*b* of the spring 2 so as to be combined with the conical guide member 5 disposed upon the above first clamping means 3 at their ends and thereby form a conical portion having a pitch such that it may provide a curve substantially equal to that of the second conical portion 2*c* to be formed.

Figure 8A:
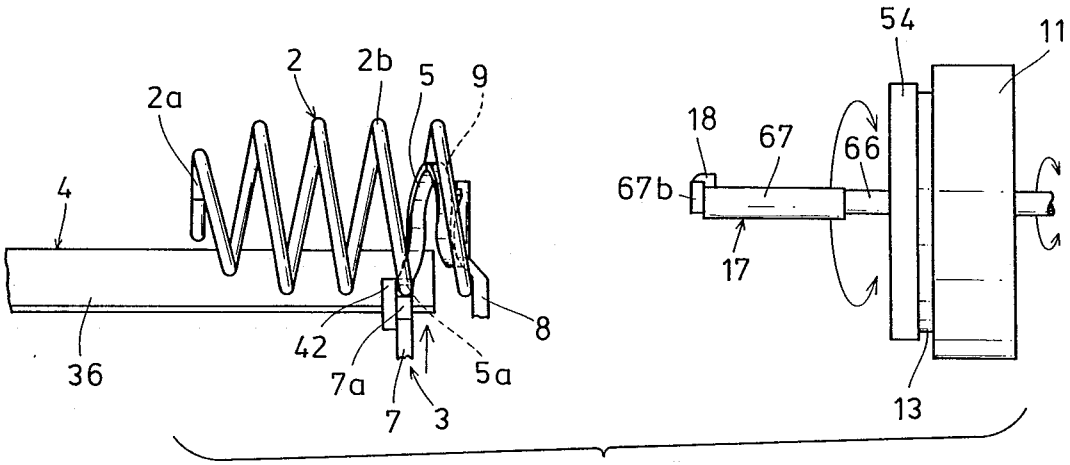
Figure 8B:
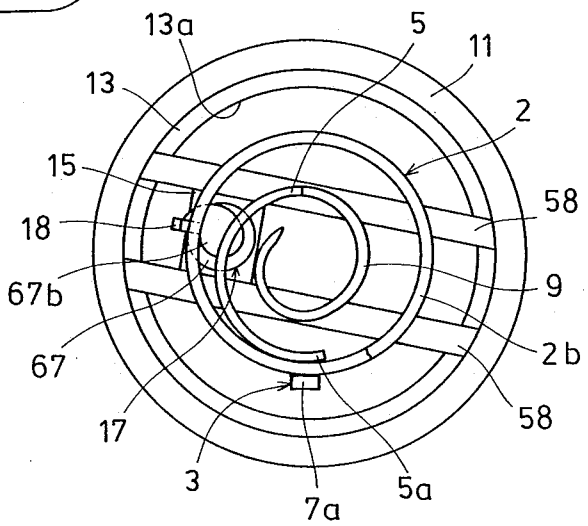

Next, the cylinder 6 is actuated, and the lever 7 is pivoted about the pin 44 in the required direction as shown in FIG. 8 so as to clamp the cylindrically wound portion 2*b* securely, between the clamping member 7*a* of the first clamping means 3 and the base portion 5*a* of the conical guide member 5, at the site from which transformation of the cylindrically wound portion 2*b* into a conical portion is started. Incidentally, in this state, the movable head 11 is disposed in a waiting posture at a position spaced at the maximum distance from the bed 4; whereas the slider 15 is shifted diametrically to a position at the maximum distance from the center of the rotor 13, and the clamping member 18 attached to the end of the winding means 17 disposed upon the slider 15 is disposed in an open posture and waiting for performance of its clamping operation as shown in FIG. 8(*b*).

A required sensor (not shown) detects the location of the open end of the cylindrically wound portion 2*b* of the semi-finished spring 2 loaded upon the bed 4, and the servomotor 14 disposed upon the movable head 11 is driven for forward or reverse motion based upon the command from the CPU 24 so as to rotate the rotor 13; whereby the winder 67 of the winding means 17 disposed upon the slider 15 is directed toward the open end of the cylindrically wound portion 2*b*. In addition, the main shaft 68 and the rotary shaft 66 are rotated in the direction opposite to the direction of winding the second conical portion 2*c* of the semi-finished spring 2 so as to move the above clamping member 18 to a position where it can clamp the open end of the semi-finished spring 2, as shown in FIG. 8(*b*).

Figure 9B:
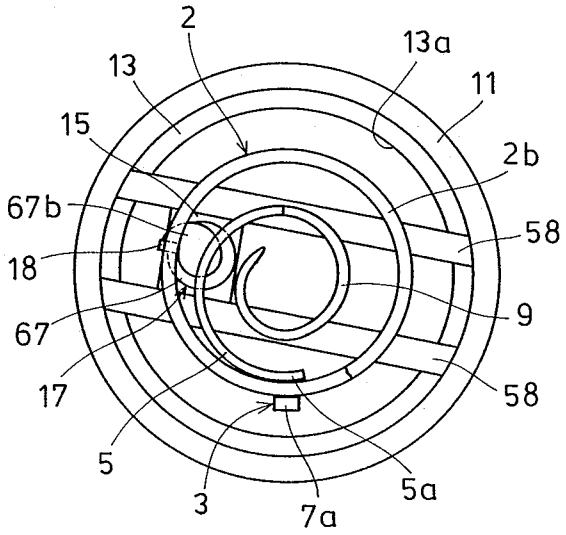
Figure 9A:
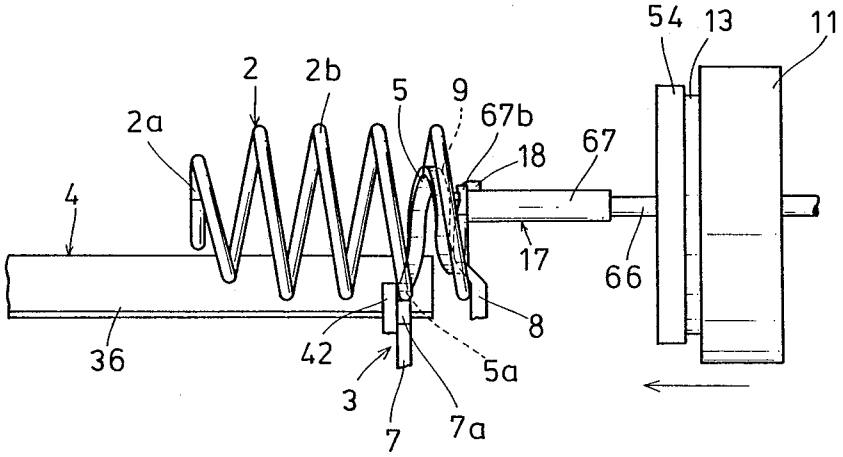

Next, the servomotor 12 is driven so as to rectilinearly move the movable head 11 supporting thereon the rotor 13 toward the semi-finished spring 2 loaded upon the bed 4 (see FIG. 9(*a*)); Whereby the horizontal projection 18*b* of the clamping member 18 disposed in an open posture and the movable head 11 supporting thereon the rotor 13 are forwarded straight toward the semi-finished spring 2 loaded upon the bed 4 (see FIG. 9(*a*)). Thus, the open end of the cylindrically wound portion 2*b* of the spring 2 is positioned between the horizontal projection 18*b* of the clamping member 18 disposed in the open posture and the circumference of the guide piece 67*b*.

As described above, since the location of the movable head 11 after its travel has been detected by means of the encoder 23, the servomotor 12 is stopped at this point through means of a command from the control circuit of CPU 24. At this time, the servomotor 16 is rotated so as to move the clamping member 18 closer to the guide piece 67*b*, as shown in FIG. 5(*b*), so as to securely clamp the open end of the spring 2 there between.

Upon rotation of the main shaft 68 to be driven by means of this servomotor 16, the key 70 disposed upon the main shaft 68 is abutted against the end of the key groove 66*a* of the rotary shaft 66 so as to drive the main shaft 68 and the rotary shaft 66 in unison. Thus, the end of the cylindrically wound portion 2*b* of the semi-finished spring 2 is forced to be turned. Furthermore, by driving the servomotor 20 so as to shift the slider 15 in the diametrical direction with respect to the rotor 13, a winding motion toward the axis of the spring 2 is imparted to the cylindrically wound portion 2*b* clamped by means of the clamping member 18 while the slider 15 slides diametrically toward the center of the rotor 13.

Figure 10B:
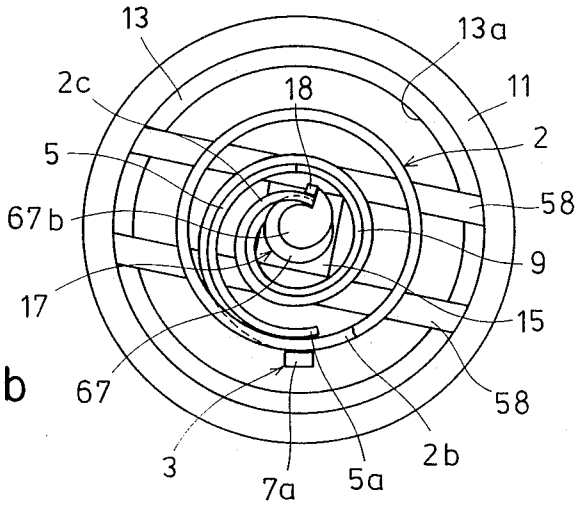
Figure 10A:
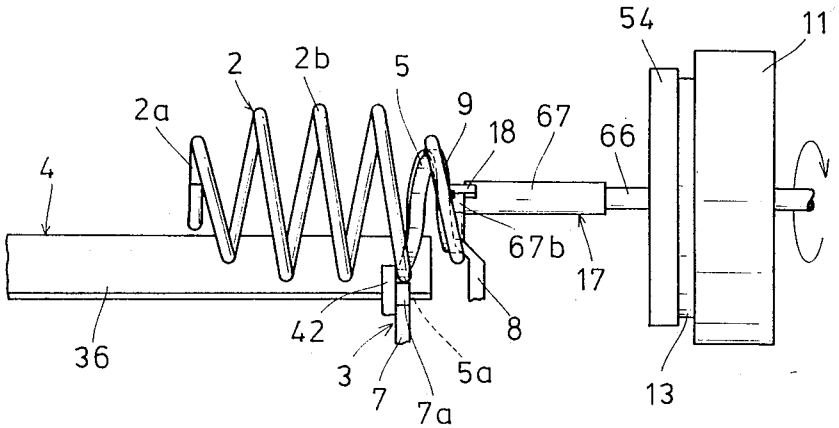
Figure 11B:
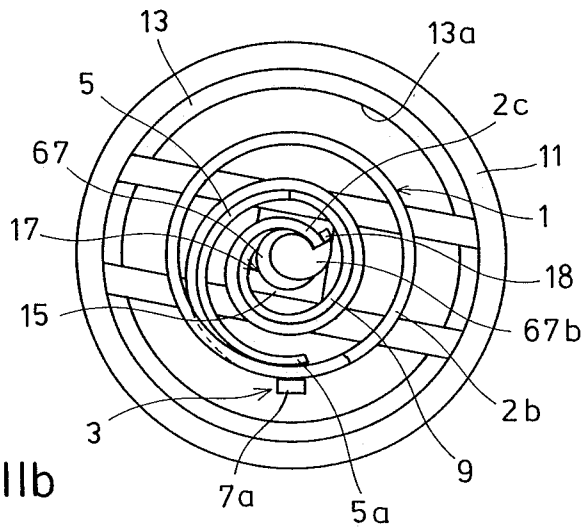
Figure 11A:
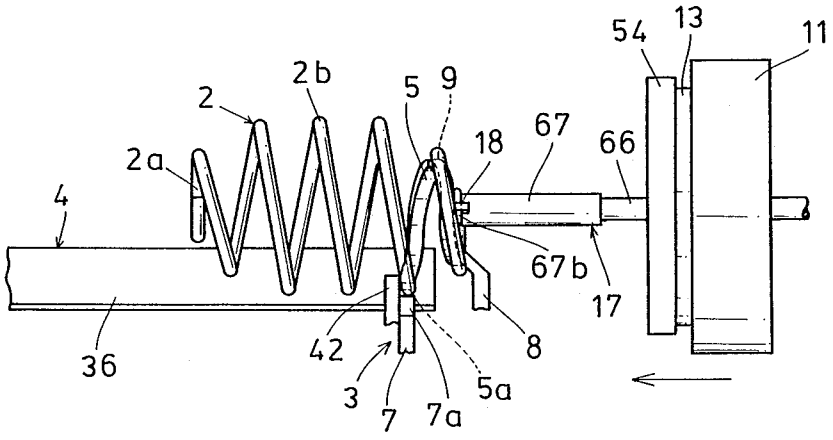

Consequently, the cylindrically wound portion 2*b* is wound and formed along the conical coil portion formed by means of the above conical guide members 5 and 9 so as to finally form the second conical portion 2*c* having a required pitch as shown in FIG. 10(*b*). Furthermore, upon driving of the servomotor 12, the movable head 11 moves slightly toward the bed 4 (see FIG. 11), whereby the wound end portion of the second conical portion 2*c* is moved backwardly in the axial direction so as to form a flat coil end and thereby finally provide a double-coned spring having the first conical portion 2*a* and the second conical portion 2*c* combined at their base portions.

Incidentally, if the slider 15 is shifted toward the axis of the rotor 13, that is, to a position off-set from the axis of the semi-finished spring 2, a spring whose second conical portion 2*c* has a center off-set from the center of the cylindrically wound portion 2*b* can be formed.

After completion of this winding process of forming the second conical portion 2*c*, the clamping by means of the second clamping member 18 is released, and when the winding means 17 is retracted together with the movable head 11, this clamping member 18 moves away from the wound end of the second conical portion 2*c*. Furthermore, as the location regulating means 8 retracts, the clamping of the double-coned spring 1 by means of the first clamping means 3 is released, and the above double-coned spring 1 is, for example, held by means of a hand (not shown) such as, for example, of a manipulator and the spring is thereafter lifted directly upwardly so as to be forwarded to the subsequent hardening process.

Obviously, many modifications and variations of the present invention are possible in light of the above teachings. It is therefore to be understood that within the scope of the appended claims, the present invention may be practiced otherwise than as specifically described herein.

What is claimed is:

1. Apparatus for making a double-coned spring by using a semi-finished spring having formed upon one end thereof a first conically wound portion, and a cylindrically wound portion extending axially about a longitudinal axis thereof from said first conically wound portion toward an opposite open end of said semi-finished spring and from which a second conically wound portion can be formed, comprising:

bed means for supporting said semi-finished spring;

first clamping means disposed upon said bed for releasably clamping said semi-finished spring at a predetermined location from where formation of said second conically wound portion is to be started;

first conical guide means operatively connected to said first clamping means and having a predetermined pitch for defining a curve which is substantially equal to that of said second conically wound portion to be formed from said semi-finished spring;

second conical guide means, movably mounted upon said bed in an axial direction along said longitudinal axis of said cylindrically wound portion of said semi-finished spring so as to be axially inserted through said open end of said semi-finished spring, for disposition in mating relationship with said first conical guide means so as to form a combined conical guide means within said cylindrically wound portion about which a free end portion of said semi-finished spring, at said open end thereof, can be wound so as to form said second conically wound portion of said double-coned spring;

a head axially movable toward and away from said bed;

second clamping means disposed upon said movable head for releasably clamping said free end portion of said semi-finished spring;

means for rotating said second clamping means in the direction of winding said semi-finished spring; and means for moving said second clamping means radially inwardly toward said axis of said semi-finished spring so as to complete formation of said second conically wound portion of said double-coned spring.

2. The apparatus for making a double-coned spring according to claim 1, wherein a rotor having a center line substantially aligned with the axis of the semi-finished spring disposed upon said bed is rotatably mounted upon said movable head, and a slider having a winding means disposed thereon for cooperation with said second clamping means (is disposed upon said rotor) so that it can be reciprocated in (a diametrical direction) of said rotor.

3. The apparatus of making a double-coned spring according to claim 2, wherein said winding means is disposed upon the slider so that it can be rotated in the direction of winding the semi-finished spring, and said second clamping means is disposed upon the end of the winding means, extending parallel to the rotation center of the rotor.

4. A method of making a double-coned spring from a semi-finished having formed upon one end thereof a first conically wound portion, and a cylindrically wound portion extending axially about a longitudinal axis thereof from said first conically wound portion toward an opposite open end of said semi-finished spring and from which a second conically wound portion can be formed, comprising the steps of:

releasably clamping said semi-finished spring at a predetermined location of said cylindrically wound portion from where formation of said second conically wound portion is to be started;

disposing a first conical guide member, having a predetermined pitch for defining a curve which is substantially equal to that of said second conically wound portion to be formed from said semi-finished spring, internally within said cylindrically wound portion of said semi-finished spring;

axially moving a second conical guide member, along said longitudinal axis of said cylindrically wound portion of said semi-finished spring so as to be axially inserted through said open end of said semi-finished spring, and positioning said second conical guide member in mating relationship with said first conical guide member so as to form a combined conical guide member said cylindrically wound portion about which a free end portion of said semi-finished spring, at said open end thereof, can be wound so as to form said second conically wound portion of said double-coned spring;

releasably clamping said free end portion of said semi-finished spring;

rotating said clamped free end portion of said semi-finished spring so as to wind said free end portion of said semi-finished spring about said combined conical guide member; and moving said free end portion of said semi-finished spring radially inwardly toward said axis of said semi-finished spring so as to complete formation of said second conically wound portion of said double-coned spring.

* * * * *